US009039434B2

(12) United States Patent
Winningham et al.

(10) Patent No.: US 9,039,434 B2
(45) Date of Patent: May 26, 2015

(54) PLUG AND SOCKET FOR PROVIDING ELECTRICAL POWER TO VEHICLE ACCESSORIES

(71) Applicant: COLIANT CORPORATION, Warren, MI (US)

(72) Inventors: Matthew Winningham, Royal Oak, MI (US); John Swiatek, Shelby Township, MI (US)

(73) Assignee: Coliant Corporation, Warren, MI (US)

( * ) Notice: Subject to any disclaimer, the term of this patent is extended or adjusted under 35 U.S.C. 154(b) by 27 days.

(21) Appl. No.: 14/025,603

(22) Filed: Sep. 12, 2013

(65) Prior Publication Data

US 2014/0073161 A1 Mar. 13, 2014

Related U.S. Application Data

(60) Provisional application No. 61/700,076, filed on Sep. 12, 2012, provisional application No. 61/830,433, filed on Jun. 3, 2013.

(51) Int. Cl.

| | |
|---|---|
| ***H01R 13/52*** | (2006.01) |
| ***H01R 24/04*** | (2006.01) |
| ***H01R 13/717*** | (2006.01) |

(Continued)

(52) U.S. Cl.

CPC ..... *H01R 13/521* (2013.01); *H01R 13/7175* (2013.01); *H01R 13/5213* (2013.01); *H01R 24/38* (2013.01); *H01R 31/02* (2013.01); *H01R 31/06* (2013.01)

(58) Field of Classification Search

CPC ..... H01R 2105/00; H01R 2103/00

USPC ..... 439/271–279, 587, 668

See application file for complete search history.

(56) References Cited

U.S. PATENT DOCUMENTS

| | | | |
|---|---|---|---|
| 2,717,367 | A | 9/1955 | Puerner |
| 5,165,834 | A | 11/1992 | Takenouchi et al. |

(Continued)

FOREIGN PATENT DOCUMENTS

| | | | |
|---|---|---|---|
| CA | 2471946 | C | 5/2009 |
| DE | 202012009974 | U1 | 3/2013 |
| WO | 2013076552 | A1 | 5/2013 |

OTHER PUBLICATIONS

Road Vehicles—Electrical Connections—Double-pole connection, International Standard, ISO 4165, Reference No. ISO 4165:2001(E).

*Primary Examiner* — Chandrika Prasad

(74) *Attorney, Agent, or Firm* — Dickinson Wright, PLLC

(57) ABSTRACT

A plug including a housing that defines a cavity and an opening into the cavity. A flange extends radially inwardly into the opening of the housing. A tip assembly is received by the opening of the housing. The tip assembly includes a positive terminal that extends between a proximal portion in the cavity of the housing and a distal portion outside of the housing for electrical connection with the vehicle accessory. The tip assembly includes a sleeve that is sealingly disposed about the proximal portion of the positive terminal. The sleeve includes a projection that extends radially outwardly therefrom adjacent to the proximal portion of the positive terminal in sealing engagement with the flange of the housing to sealingly interconnect the tip assembly and the housing for preventing liquids from flowing from outside of the housing between the positive terminal and the sleeve into the cavity of the housing.

17 Claims, 8 Drawing Sheets

(51) Int. Cl.

| | |
|---|---|
| ***H01R 31/02*** | (2006.01) |
| *H01R 24/38* | (2011.01) |
| *H01R 31/06* | (2006.01) |

(56) References Cited

U.S. PATENT DOCUMENTS

| | | | | |
|---|---|---|---|---|
| 5,201,677 | A * | 4/1993 | Takayama | 439/668 |
| 5,309,336 | A | 5/1994 | Hartt et al. | |
| 5,704,812 | A * | 1/1998 | Moji | 439/668 |
| 5,924,895 | A * | 7/1999 | Moji | 439/668 |
| 6,619,983 | B2 | 9/2003 | Ota et al. | |
| 7,033,209 | B2 | 4/2006 | Swiatek et al. | |
| 7,198,512 | B1 | 4/2007 | Swiatek | |
| 7,230,195 | B2 | 6/2007 | Ohnishi | |
| 7,744,395 | B1 | 6/2010 | Cantolino | |
| 7,901,249 | B1 * | 3/2011 | Chen | 439/607.4 |
| 7,972,142 | B2 | 7/2011 | Swiatek et al. | |
| 2007/0207668 | A1 * | 9/2007 | Masuzaki | 439/587 |
| 2009/0091292 | A1 | 4/2009 | Nippear et al. | |
| 2009/0275226 | A1 * | 11/2009 | Chen | 439/271 |
| 2011/0111612 | A1 * | 5/2011 | Su et al. | 439/271 |
| 2011/0111613 | A1 * | 5/2011 | Su et al. | 439/271 |
| 2011/0130035 | A1 * | 6/2011 | Ebihara | 439/587 |
| 2011/0195611 | A1 | 8/2011 | Little et al. | |
| 2011/0223806 | A1 | 9/2011 | You | |
| 2011/0237103 | A1 | 9/2011 | Harlan et al. | |

* cited by examiner

PLUG AND SOCKET FOR PROVIDING ELECTRICAL POWER TO VEHICLE ACCESSORIES

CROSS REFERENCE TO RELATED APPLICATION

This application claims the benefit of U.S. Provisional Patent Application Ser. No. 61/700,076 filed Sep. 12, 2012 and 61/830,433 filed Jun. 3, 2013 which are hereby incorporated by reference as though set forth fully herein.

BACKGROUND OF THE DISCLOSURE

1. Field of the Disclosure

An apparatus for providing electrical power to a vehicle accessory.

2. Description of the Prior Art

Apparatuses for providing power to vehicle accessories are known in the art. More specifically, plug and socket connector combinations have become increasingly popular to provide power to vehicle accessories like mobile GPS navigation units, mobile phones and MP3 players on various types of vehicles. One such apparatus is disclosed in U.S. Pat. No. 5,704,812 to Eiro Moji which apparatus for providing power to a vehicle accessory including a plug that includes a housing which defines a cavity and an opening into the cavity. The plug further includes a tip assembly that is received by the opening of the housing. The tip assembly includes a positive terminal that extends along an axis between a proximal portion in the cavity of the housing and a distal portion outside of the housing for electrical connection with the vehicle accessory.

Such plug and socket combinations have become increasingly popular for use with open-air vehicles like motorcycles, ATV's, snowmobiles, convertible automobiles, pick-up truck beds, marine boats, farm tractors, etc. Since these vehicles are commonly exposed to rain, snow, hail, etc., there is an increasing need for improvements to such plug and socket combinations to make them more water-resistant, U.V. stable, vibration proof, oil and gas resistant, and glove friendly which will minimize damage to the plug and socket connectors. Additionally, since certain plug housing designs are better suited for particular applications, there remains a need for more cost effective customizable plug designs.

SUMMARY AND ADVANTAGES OF THE DISCLOSURE

The disclosure provides for such an apparatus for providing power to a vehicle accessory wherein the tip assembly further includes a sleeve of organic polymeric material sealingly disposed about the proximal portion of the positive terminal for preventing liquids from flowing from outside of the housing between the positive terminal and the sleeve into the cavity of the housing.

Thus several advantages of one or more aspects are that the projection of the tip assembly and flange of the housing provide for a liquid proof seal for the tip assembly that can universally be used on housings of various shapes and sizes for use on particularly configured outdoor vehicles. Accordingly, the present disclosure provides for a universally adaptable tip assembly that reduces manufacturing costs in making such power apparatuses since unique tip assemblies do not need to be designed for specific housing designs.

The disclosure further provides for the proximal portion of the positive terminal defining a bore, therefore allowing the positive terminal to either be crimped to a positive wire or soldered to a circuit board. It should be appreciated that it is advantageous because it provides for low cost manufacturing of the tip assembly. Crimping of the positive terminal to the positive wire reduces the potential of fracturing the positive terminal as compared to the prior art which traditionally relies on screws to secure the positive terminal to the wires. Additionally, the proximal portion of the positive terminal is advantageously exposed in the housing cavity allowing it to be coated to reduce the potential for oxidation.

BRIEF DESCRIPTION OF THE DRAWINGS

Other advantages of the present disclosure will be readily appreciated, as the same becomes better understood by reference to the following detailed description when considered in connection with the accompanying drawings wherein.

DETAILED DESCRIPTION OF THE ENABLING EMBODIMENTS

Referring to the Figures, wherein like numerals indicate corresponding parts throughout the several views, a powering apparatus 20, 220, 320 is generally shown for attachment to a vehicle for being connected with a battery for providing power to a vehicle accessory.

Figure 2:
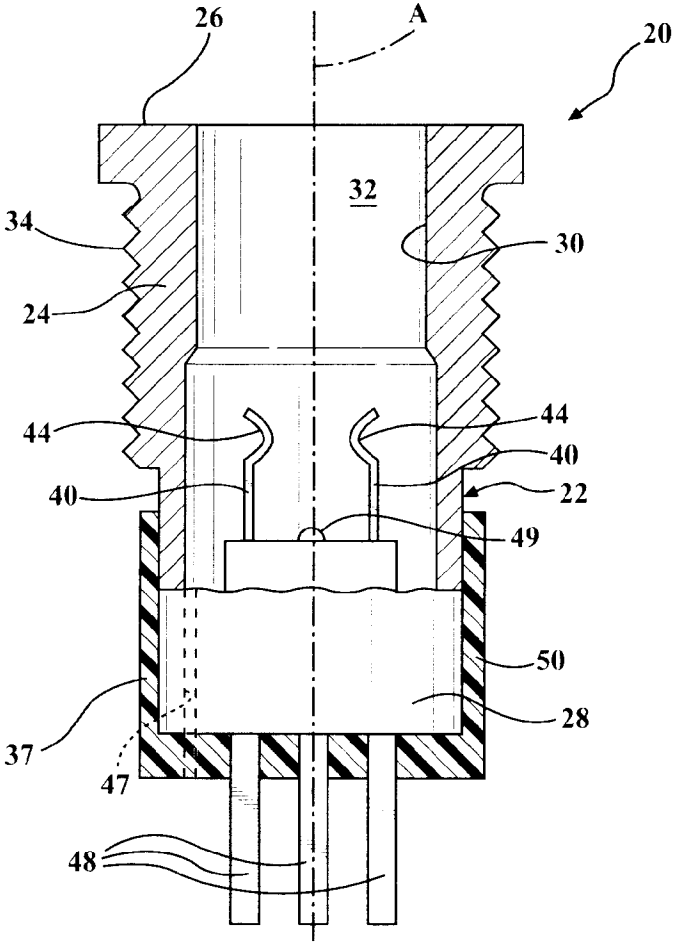
FIG. 2 is a cutaway view of the socket.
Figure 1:
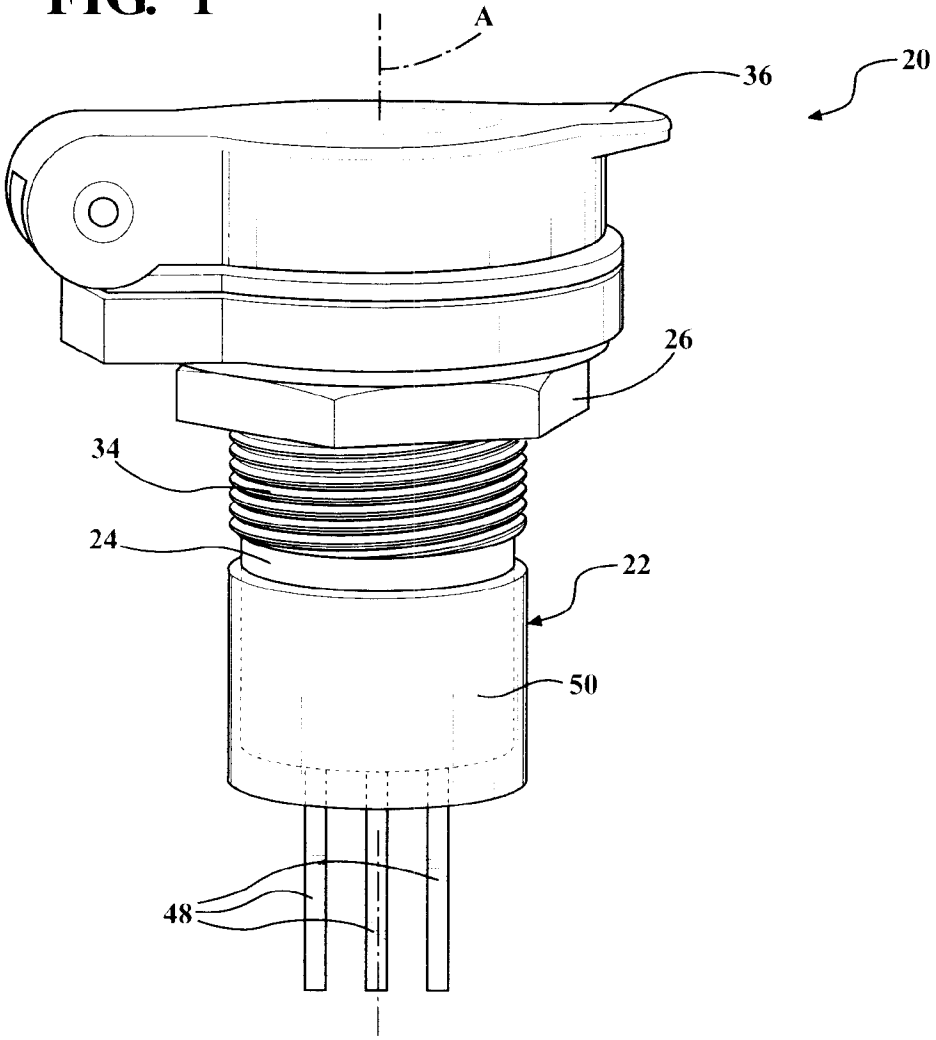
FIG. 1 is a perspective view of the socket.

As best presented in FIGS. 1 and 2, the powering apparatus 20 includes a socket 22, generally indicated, that includes a cup shaped body 24 made out of a metallic material that extends along a socket axis A from an open portion 26 to a closed portion 28. The body 24 has an inner wall 30 that defines a chamber 32 and an outer wall 34. It should be appreciated that the body 24 could be made out of any electrically conducting material and could have various shapes such as, but not limited to, a square cross-section. The outer wall 34 of the body 24 defines a plurality of threads adjacent to the open end for sealingly securing the body 24 to the vehicle. It should be appreciated that the body 24 could be secured to the vehicle in other ways such as, but not limited to, by using an adhesive, or a mounting bracket. The socket 22 further includes a socket lid 36 that pivotally engages the body 24 at the open portion 26 of the body 24 for opening and sealingly closing the chamber 32 of the body 24. It should be appreciated that other mechanisms could be used to close the chamber 32 such as, but not limited to, a plug.

Figure 2A:
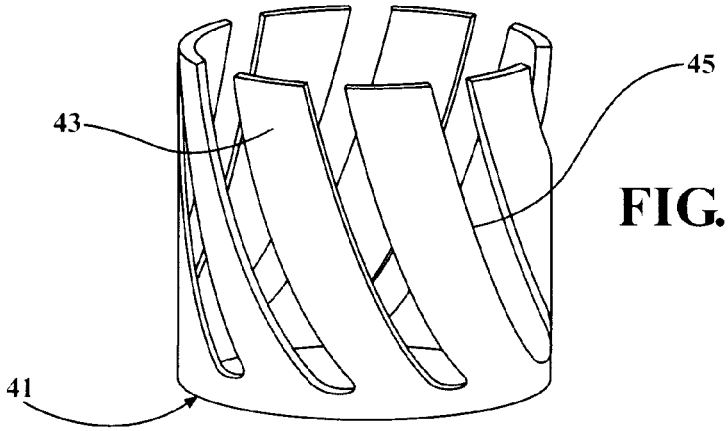
FIG. 2A is a perspective view of the spring cylinder.
Figure 3:
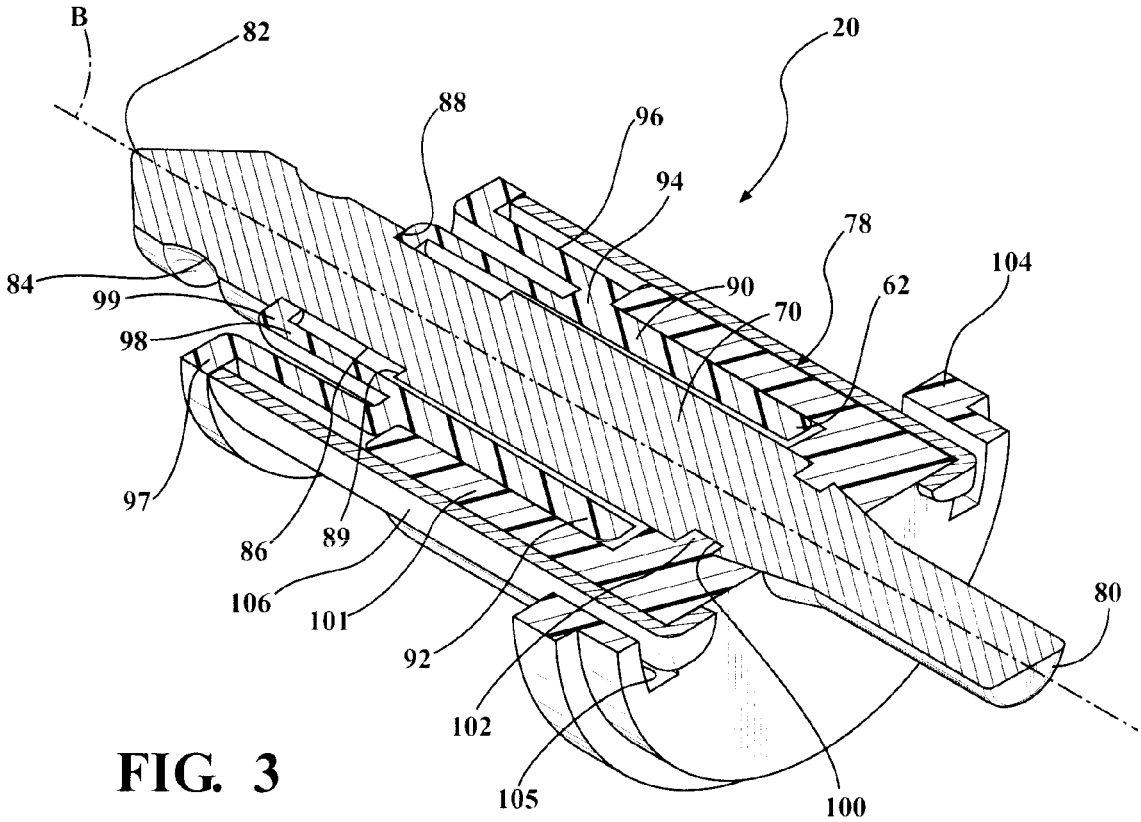
FIG. 3 is a perspective cutaway view of the tip assembly.

The socket 22 further includes a pair of spring contacts 40 that are disposed in the chamber 32 of the body 24 and extend axially away from the closed portion 28 of the body 24 in spaced and parallel relationship with one another. Each of the spring contacts 40 define an arc 44 that extends radially inwardly. The closed portion 28 of the body 24 of the socket 22 defines a pair of orifices (not shown) at the end of the socket 22. It should be appreciated that only one orifice could be defined by the body 24. A plurality of power connectors 48 extend axially from the spring contacts 40 and the inner wall 30 of the body 24, respectively, and through the orifices 46 of the closed portion 28 of the body 24. The plurality of power connectors 48 are electrically connected with the inner wall 30 of the body 24 and the spring contacts 40, respectively, for being electrically connected with the battery of the vehicle for transmitting power to the spring contacts 40. In an alternative embodiment as best presented in FIG. 2A, a spring cylinder 41 made of an electrically conductive material is used in place of the spring contacts 40 and electrically connected with the vehicle battery. The spring cylinder 41 has a wall 43 which defines a plurality of spring slots 45 extending therealong to allow the wall 43 to expand to receive a plug to hold it in place. It should be appreciated that any number of spring slots 45 could be used and they could extend in various directions.

The socket 22 further includes a casing 50 made of an organic polymer material that generally has a cup shape and is sealingly disposed about the closed portion 28 of the body 24 and the power connectors 48. It should be appreciated that the casing 50 advantageously contributes to the substantially liquid proof design of the powering apparatus 20 because it prevents liquids from entering the socket 22 through the orifices 46 and between the casing 50 and body 24. In an alternative embodiment, as best shown in FIG. 2, a vent hole 47 is defined by the body 24 of the casing for draining any liquids that have acquired in the chamber 32. The vent hole 47 is separate from the power connectors 48 to ensure that they remain dry during draining of liquids. In the enabling embodiments, the casing 50 is manufactured through an overmolding process. It should be appreciated that various organic polymeric materials could be used for the casing 50 and the other components of the present disclosure that are made out of organic polymer materials such as, but not limited to, an acrylonitrile butadiene styrene, sadiprene, and rubber.

A socket LED 49 is disposed in the chamber 32 of the socket 22 and is electrically connected with the power connectors 48 for illuminating chamber of the socket 22. It should be appreciated that the socket LED 49 could be located in any location within the chamber 32. In an alternative embodiment, only two power connectors 48 are present, and the socket LED 49 is connected to the two power connectors 48 through a sensing circuit. In the enabling embodiment, the socket LED 49 is connected to one of the three power connector 48.

As best presented in FIGS. 3 through 9, the powering apparatus 20 further includes a plug 38, 238, 338, generally indicated, for being interconnected with the socket 22 for being electrically connected with the socket 22 for powering the vehicle accessory.

The plug 38 includes a housing 54, 254, 354, made out of an organic polymer material, that defines a cavity 42, 242, 342 and an opening 45, 245, 345 into the cavity 42, 242, 342. The housing 54, 254, 354 defines a flange 56, 256, 356 that extends radially inwardly into the opening 45, 245, 345. In the first and second enabling embodiments, best presented in FIGS. 4 through 7, the housing 54, 254 comprises an upper case 58, 258 and a lower case 60, 260 that are connected at a joint 62, 262. The upper case 58, 258 includes a threaded upper tube 64, 264 that extends therefrom into the cavity 42, 242. Further, the lower case 60, 260 includes a threaded lower tube 66, 266 that extends therefrom into the cavity 42, 242 in coaxial alignment with the threaded upper tube 64, 264. A securing screw threadedly extends through the upper and lower tubes 64, 264, 66, 266 to sealingly secure the upper and lower cases 58, 258, 60, 260 together at the joint 62, 262. It should be appreciated that the upper and lower cases 58, 258, 60, 260 could be connected with one another by other methods such as, but not limited to, an adhesive, or sonic welding. In the third enabling embodiment, as best shown in FIG. 8, the upper and lower cases are integral with one another.

The shell further defines a connection aperture 68, 268, 368 for sealingly receiving a cord of the vehicle accessory to power the vehicle accessory. In the third enabling embodiment, as best presented in FIG. 8, a pair of USB ports 72 are disposed in the connection aperture 368 that are electrically connected with the plug 78 for receiving cords from the vehicle accessory for powering the vehicle accessory. An LED 74 is interconnected with the housing 354 and electrically connected with the USB port 72 for indicating when a cord is plugged into the USB port 72. It should be appreciated that the LED could indicate other aspects of the powering apparatus 20, 220, 320 or vehicle such as, but not limited to, indicating the user of the battery life of the vehicle. It should further be appreciated that any suitable USB port could be used. A USB seal 76 is pivotally interconnected with the housing 54 adjacent to the USB port 72 for opening and sealingly closing the USB port 72. It should be appreciated that any number of USB ports 72 could be present. Furthermore, it should be appreciated that other types of connection ports could be used.

The plug 38, 238, 338 further includes a tip assembly 78, generally indicated, that is received by the opening 45, 245 of the housing 54, 254, 354 for extending into the socket 22. The tip assembly 78 includes a generally cylindrical shaped positive terminal 70 that extends along a terminal axis B between a proximal portion 80 in the cavity 42 of the housing 54, and a distal portion 82 outside of the housing 54 for electrical connection with the vehicle accessory and socket 22. The proximal portion 80 defines a bore (not shown) for receiving a positive wire 81 in electrical communication with the vehicle accessory. In the first and second enabling embodiments, the proximal portion 80 is crimped around the positive wire 81 to establish electrical connection between the positive terminal 70 and the vehicle accessory.

Figure 5:
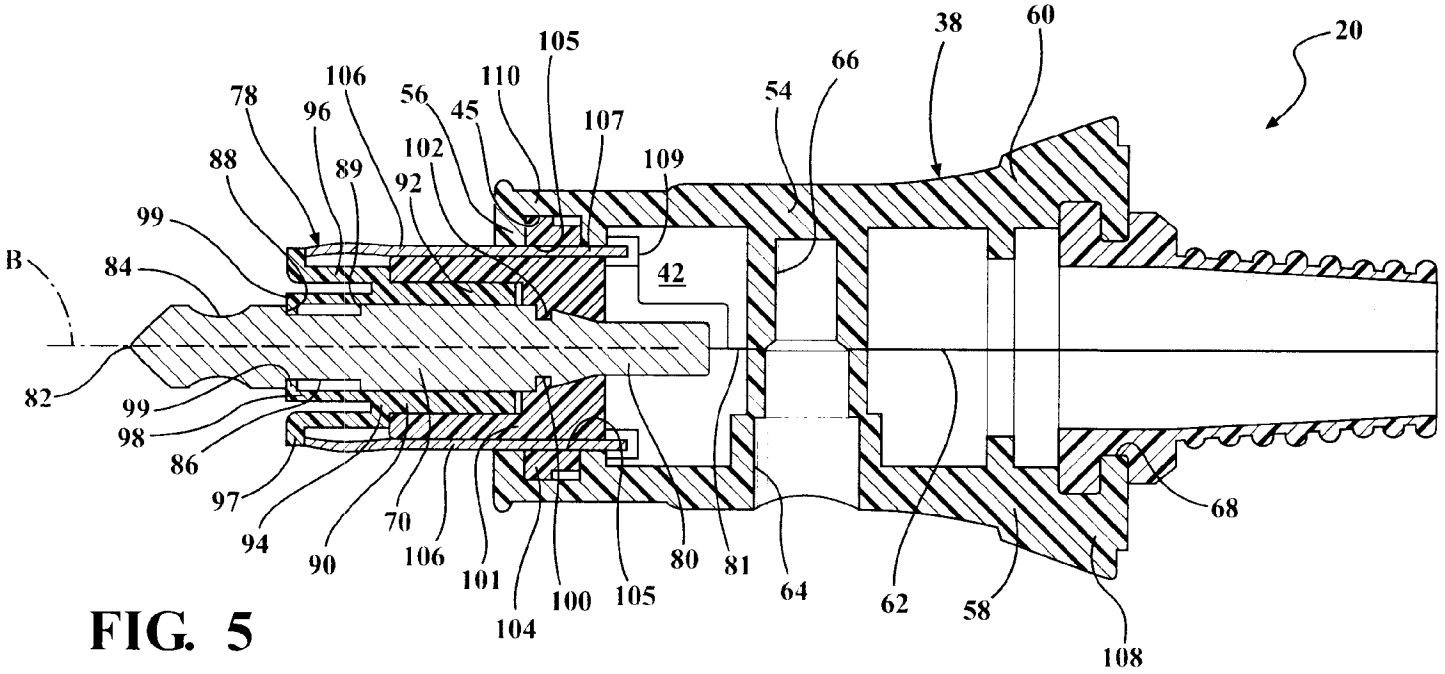
FIG. 5 is a cutaway side view of the first enabling embodiment of the plug.
Figure 5A:
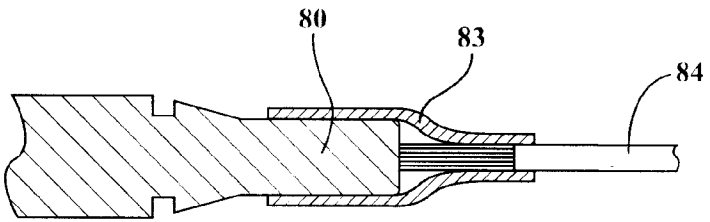
FIG. 5A is a cutaway view of the wire harness and proximal end of the positive terminal.
Figure 6:
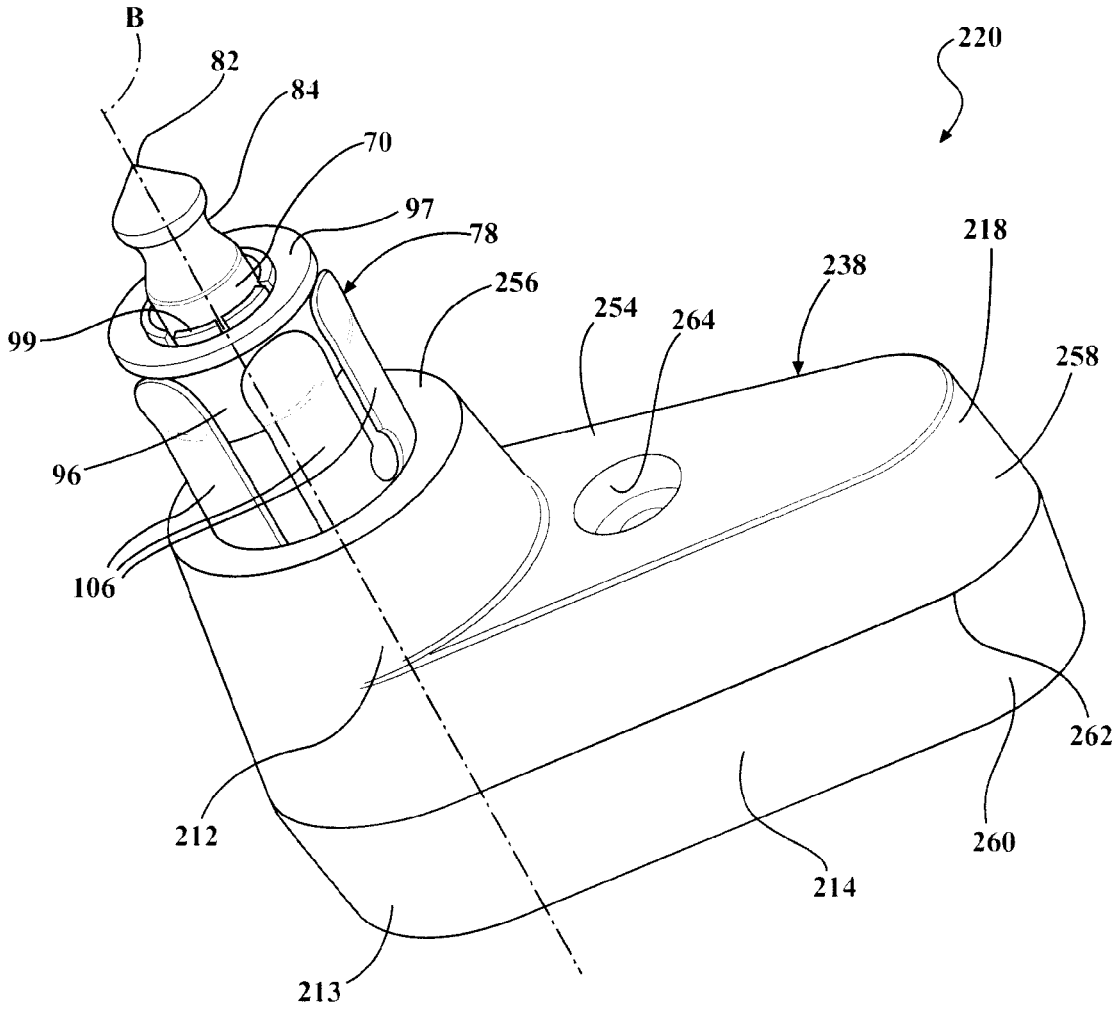
FIG. 6 is a perspective view of the second enabling embodiment of the plug.

Alternatively, as best presented in FIG. 5A, a wire including a wiring harness 83 is disposed about the proximal portion 80 of the positive terminal and the positive wire 81 for securing the positive wire 81 and the positive terminal 70. It should be appreciated that the proximal portion 80 could then be crimped about the wiring harness 83 to improve securement of the positive terminal and the positive wire 81. It should be appreciated that the positive terminal 70 could have other cross-sectional shapes such as, but not limited, to a square-shaped cross section.

Figure 9:
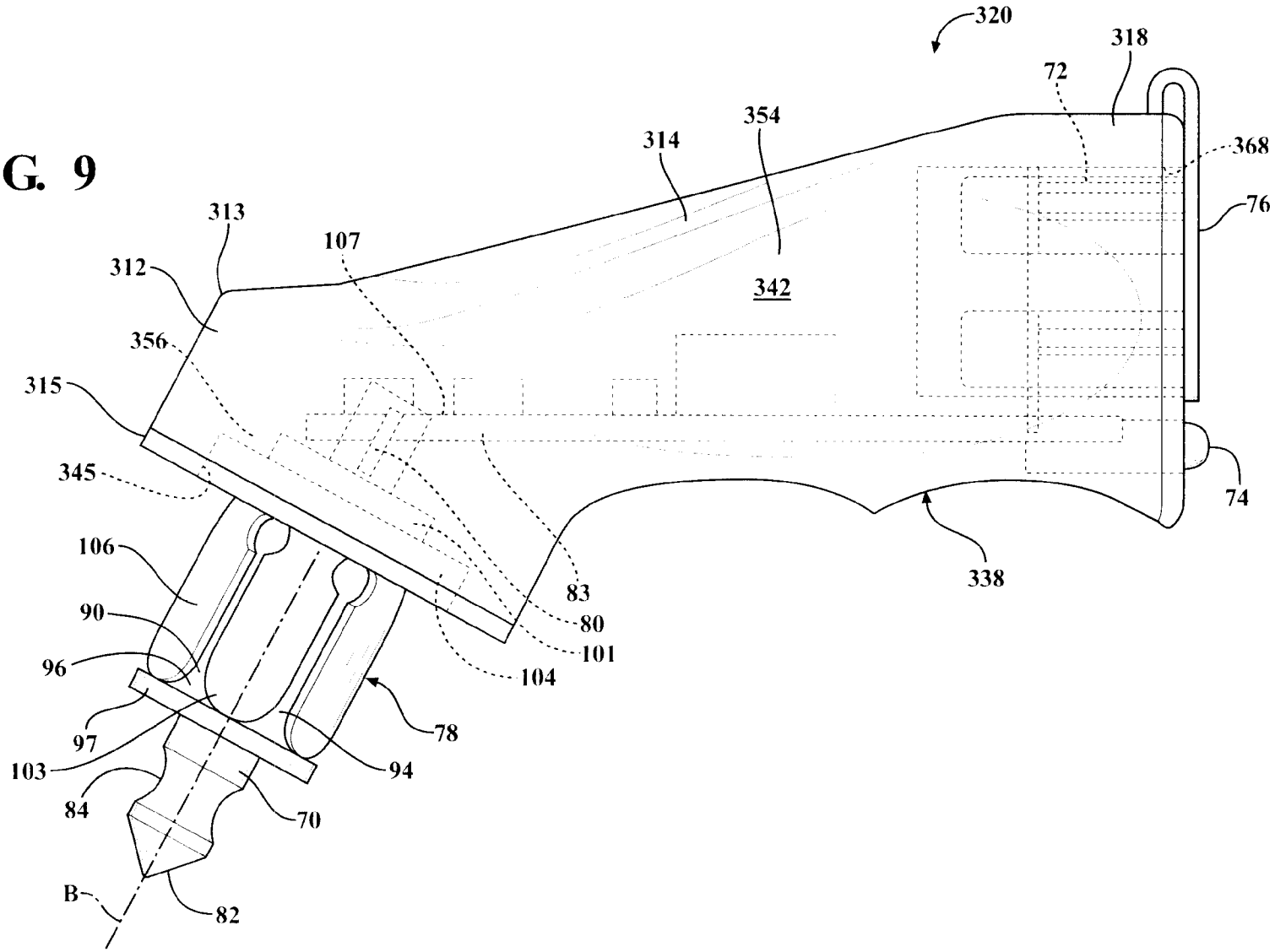
FIG. 9 is a cutaway view of the third enabling embodiment of the plug.

In the third enabling embodiment as best presented in FIG. 9, the proximal portion 80 extends through and is soldered to a circuit board 83 to establish electrical communication with the circuit board 83, which is thereby in electrical communication with the vehicle accessory.

The positive terminal 70 has a conical shaped apex at the distal portion 82 for guiding the positive terminal 70 between the spring contacts 40 when the plug 38 is inserted into the socket 22. Further, the positive terminal 70 defines a curve-shaped groove 84 that extends radially into the main positive terminal 70 adjacent to the tip for receiving the arc 44 of the spring contacts 40 when the plug 38 is inserted into the socket 22 for elastically holding the plug 38 in the socket 22 to electrically connect the positive terminal 70 of the plug 38 and spring contacts 40 of the socket 22.

It should be appreciated that it is advantageous that the cylindrical shape of the positive terminal 70 defining a bore allows the positive terminal 70 to either be crimped to the positive wire 81 or soldered to the circuit board 83 because it provides for low cost manufacturing of the tip assembly 78, especially in comparison to prior art terminals which rely upon screws to secure the terminal to the positive wire. Crimping of the positive terminal 70 to the positive wire 81 reduces the potential of fracturing the positive terminal 70 in comparison to those of the prior art during manufacturing and use. Additionally, crimping provides for an easier manufacturing step than attaching the screws of the prior art. Additionally, the proximal portion of the positive terminal 70 is advantageously exposed in the housing cavity 42, 242, 342, allowing it to be coated to reduce the potential for oxidation during manufacturing.

The positive terminal 70 further defines a recess 86 that is spaced axially toward the proximal portion 80 from the groove 84 and has a generally rectangular shaped cross-section that extends radially inwardly along a front barrier 88 and a rear barrier 89 that extend in spaced and parallel relationship with one another.

The tip assembly 78 also includes a sheath 90 of organic polymeric material that is sealingly disposed annularly about the positive terminal 70 and extends between a back portion 92 adjacent to the center of the positive terminal 70 and a front portion 94 adjacent to the distal portion 82 of the positive terminal 70 for preventing liquids from flowing between the sheath 90 and the positive terminal 70. In the enabling embodiments, the sheath 90 is sealed about the positive terminal 70 through an overmolding process, but it should be appreciated that other processes could be used. The front portion 94 of the sheath 90 includes an outside sheath leg 96 that is positioned radially outwardly from the positive terminal 70. The outside sheath leg 96 defines an outside sheath leg protuberance 97 that extends radially outwardly therefrom for engaging the inner wall 30 of the body 24 of the socket 22 inside the cavity 42 when the tip assembly 78 is inserted in the socket 22. It should be appreciated that the sheath 90 contributes to the substantially liquid proof design of the plug apparatus 20, 220, 320 by preventing liquids from passing between the sheath 90 and the positive terminal 70.

The front portion 94 of the sheath 90 further includes a plurality of inside sheath legs 98 that are disposed radially inwardly from the outside sheath legs 96. The inside sheath legs 98 each include an inside sheath leg lip 99 that extends radially inwardly into the recess 86 in engagement with the front barrier 88 of the positive terminal 70 for restricting radially outward movement of the positive terminal 70 relative to the sheath 90.

The positive terminal 70 further defines a generally square shaped trough 100 that extends radially about the positive terminal 70 at an axial location adjacent to the proximal portion 80 of the positive terminal 70. The tip assembly 78 further includes a generally cup-shaped sleeve 101 made of an organic polymeric material generally that is disposed about the back portion 92 of the sheath 90 and the proximal portion 80 of the positive terminal 70. The sleeve 52 includes a square shaped extension 102 that has a generally square shape that extends radially inwardly into the trough 100 of the positive terminal 70 for sealingly interconnecting the positive terminal 70 and the sleeve 101. It should be appreciated that the trough 100 and extension 102 could have other shaped cross-sectional shapes such as, but not limited to, a circular cross-section.

The sleeve 101 has a generally L-shaped projection 104 that extends radially outwardly therefrom adjacent to the proximal portion 80 of the positive terminal 70 and is in sealing engagement with the flange 56, 256, 356 of the housing 54, 254, 354 to sealingly interconnect the tip assembly 78 and the housing 54, 254, 354. Since the projection 104 of the tip assembly 78 and flange 56, 256, 356 of the housing 54, 254, 354 provide for a liquid proof seal for the tip assembly 78 that can universally be used on housings of various shapes and sizes for various weather conditions on different types of outdoor vehicles. Accordingly, the present disclosure provides for a universally adaptable tip assembly 78 since unique tip assemblies do not need to be designed for specific housing designs. It should further be appreciated that the projection 104 could have other shapes that provide for interconnection of the projection 104 and the flange 56, 256, 356 of the housing 54, 254, 354.

The projection 104 of the sleeve 101 defines a plurality of slots 105 that extend axially therethrough and are spaced radially about the projection 104. A plurality of negative terminals 106 each extend axially adjacent to the positive terminal 70 for flexibly engaging the inner wall 30 of the body 24 of the socket 22, therefore electrically connecting the negative terminals 106 and the socket 22 to ground the plug 38. The negative terminals 106 are joined at a negative terminal rear portion 101 inside the housing 54, 254, 354 and extend to a negative terminal front portion 103 outside of the housing 54, 254, 354. A negative terminal housing connection 107 extends away from the negative terminal rear portion 101 inside the housing 54, 254, 354 for being electrically connected with the vehicle accessory. In the enabling embodiments, the negative terminal housing connection 107 is a spade type terminal having a generally rectangular shape, but it should be appreciated that it could be other connection types. One of the negative terminals 106 extends through each of the slots 105 of the sleeve 101 to a contact end adjacent to the inside sheath leg flange. It should be appreciated that any number of slots 105 and negative terminals 106 could be used. In the enabling embodiments, the sleeve 101 is manufactured through an overmolding process, but it should be appreciated that other processes could be used. It should further be appreciated that having the positive and negative terminals 70, 106 incorporated into the tip assembly 78 further adds to the universal adaptability of the power apparatus 20, 220, 320.

Figure 7:
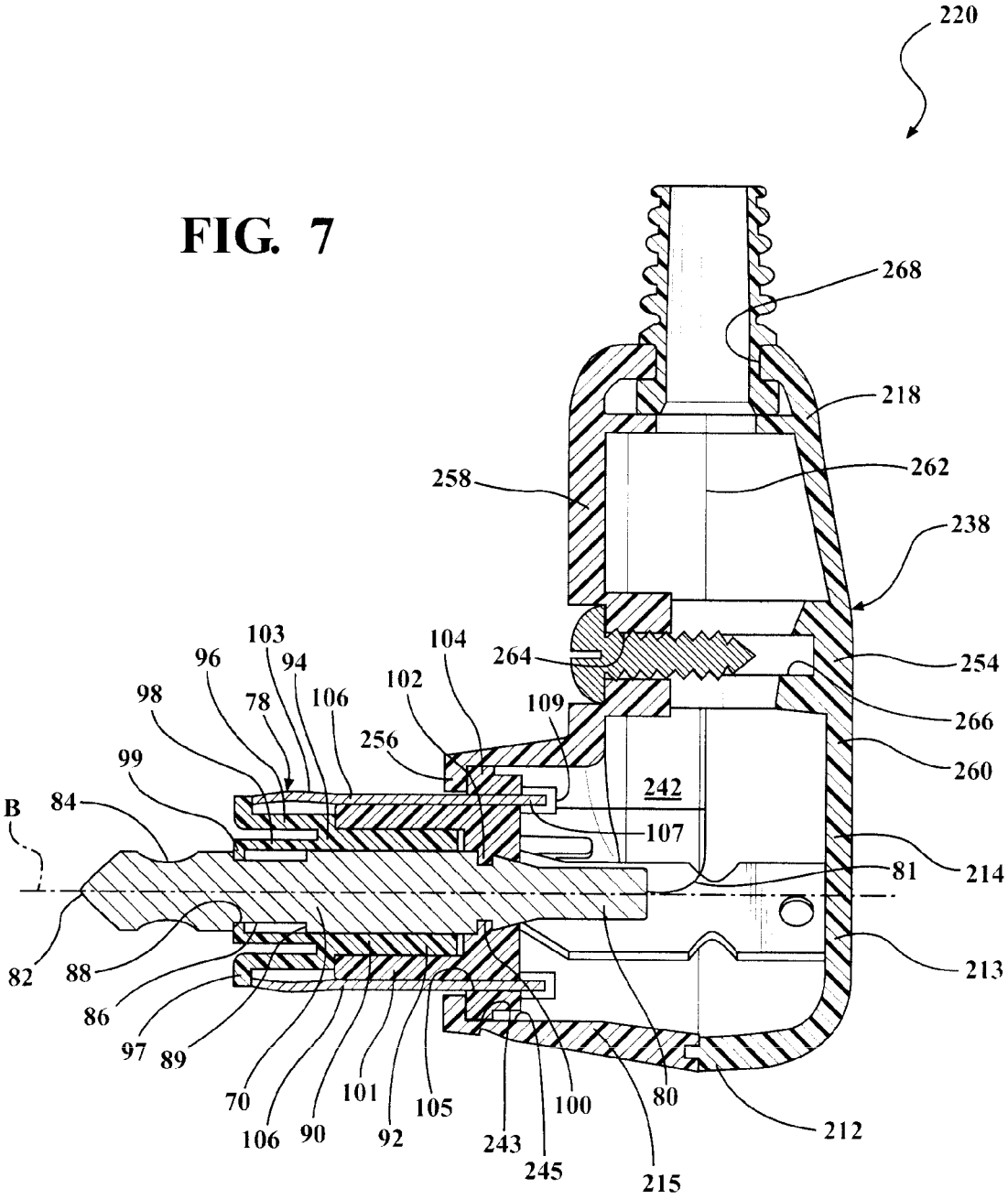
FIG. 7 is a side cutaway view of the second enabling embodiment of the plug.
Figure 8:
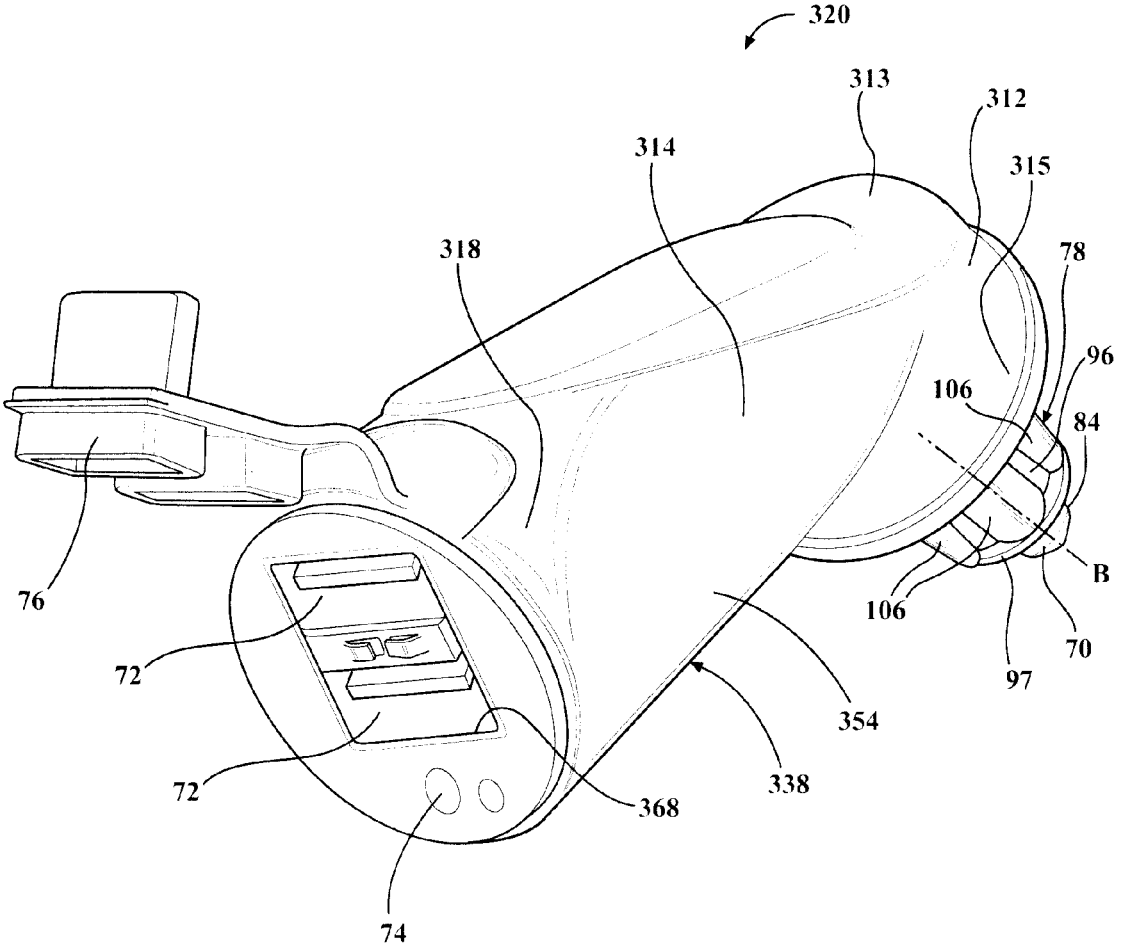
FIG. 8 is a perspective view of the third enabling embodiment of the plug.

As best presented in FIGS. 5 and 7, in the first and second enabling embodiments, the negative terminal housing connection 107 is received by a female housing connection member 109, which is in electrical communication with the vehicle accessory. As best presented in FIG. 9, in the third enabling embodiment, the negative terminal housing connection 107 extends through and is soldered to the circuit board 83 to establish electrical communication with the circuit board 83.

Figure 4:
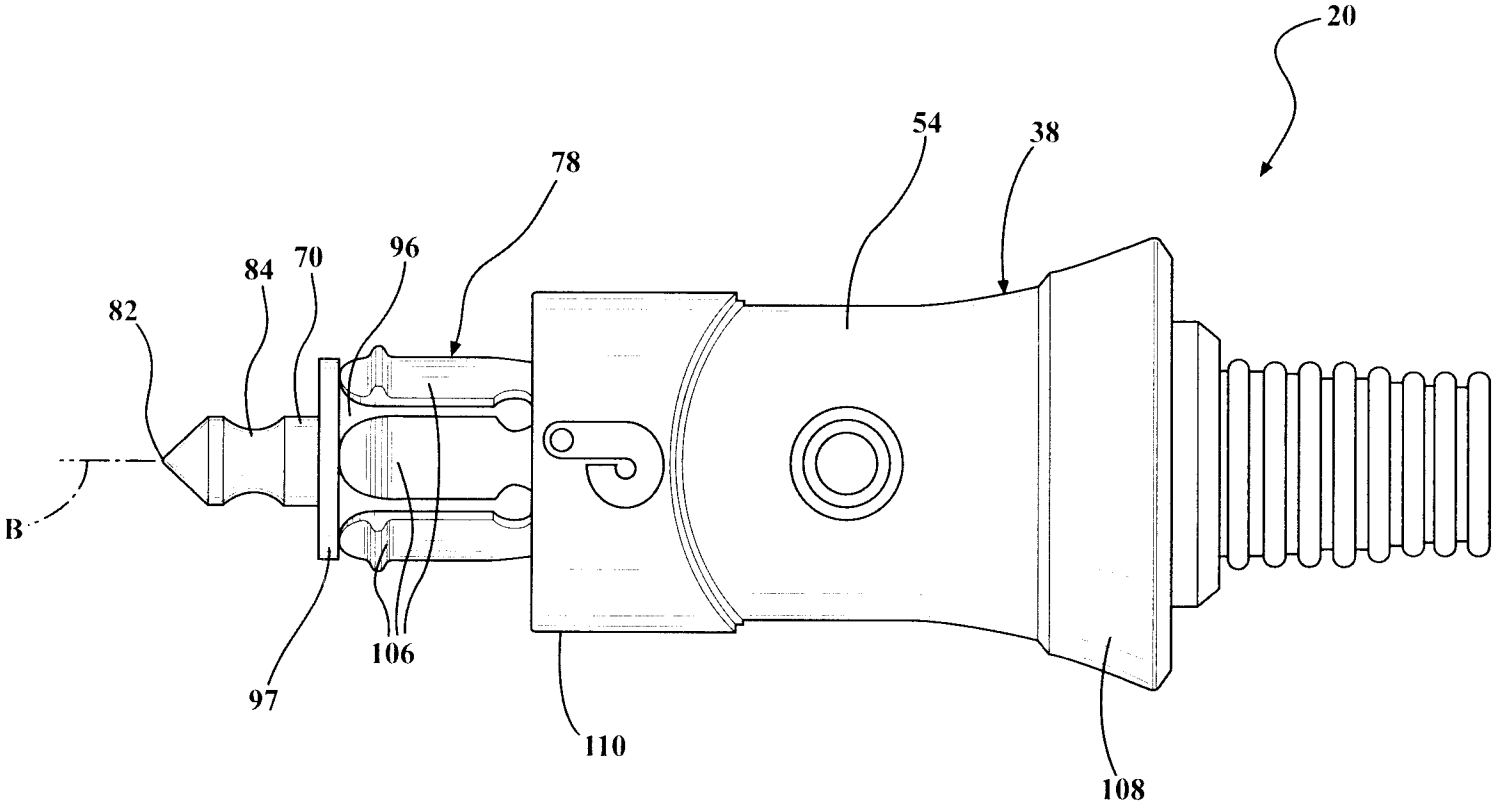
FIG. 4 is a side view of the first enabling embodiment of the plug.

It should be appreciated that the housing 54, 254, 354 could have various shapes and sizes while maintaining it's substantially liquid proof properties because of the universal adaptability of the tip apparatus. In the first enabling embodiment, as best shown in FIGS. 4 through 5, the housing 54 has a generally frustoconical shape. The housing 54 extends along the terminal axis B between a housing proximal segment 108 that defines the connection aperture 68 and a housing distal segment 110 that defines the opening 45.

In the second and third enabling embodiments, as best shown in FIGS. 5 through 9, the housing 254, 354 generally has an L-shape. The housing 254, 354 includes a horizontal portion 212, 312 that extends along the terminal axis B from a horizontal portion proximal segment 213, 313 to a horizontal portion distal segment 215, 315 that defines the opening 245. The housing 254, 354 further includes a vertical portion 214, 314 that extends generally perpendicularly away from the horizontal portion 212, 312 adjacent the horizontal portion proximal segment 213, 313 to a vertical portion distal segment 218, 318 that defines the connection aperture 68, 268, 368.

A method for manufacturing an apparatus for providing power to a vehicle accessory including a positive terminal 70 and a sleeve 101 of organic polymeric material sealingly disposed about the positive terminal 70 is also disclosed. The method comprises the step of overmolding the sleeve 101 of organic polymeric material over the positive terminal 70.

Obviously, many modifications and variations of the present disclosure are possible in light of the above teachings and may be practiced otherwise than as specifically described while within the scope of the appended claims. These antecedent recitations should be interpreted to cover any combination in which the inventive novelty exercises its utility. The use of the word "said" in the apparatus claims refers to an antecedent that is a positive recitation meant to be included in the coverage of the claims whereas the word "the" precedes a word not meant to be included in the coverage of the claims.

What is claimed is:

1. An apparatus for providing power to a vehicle accessory comprising;

a plug including a housing defining a cavity and an opening into said cavity, said plug further including a tip assembly received by said opening of said housing, said tip assembly including a positive terminal extending along an axis between a proximal portion in said cavity of said housing and a distal portion outside of said housing for electrical connection with the vehicle accessory, said tip assembly further including a sleeve of organic polymeric material sealingly disposed about said proximal portion of said positive terminal for preventing liquids from flowing from outside of said housing between said positive terminal and said sleeve into said cavity of said housing wherein, the apparatus includes at least one negative terminal extending axially adjacent to the positive terminal with its rear portion inside the cavity and its front portion outside the housing for electrical connection with the vehicle accessory for grounding the vehicle accessory, and wherein, the negative terminal is a plurality of negative terminals connected with one another at a negative terminal rear portion inside the housing.

2. An assembly as set forth in claim 1 wherein said sleeve includes a projection extending radially outwardly therefrom adjacent to said proximal portion of said positive terminal in sealing engagement with said flange of said housing to sealingly interconnect said tip assembly and said housing.

3. An assembly as set forth in claim 2 wherein said projection of said sleeve defines at least one slot extending axially therethrough.

4. An assembly as set forth in claim 3 wherein said slot is a plurality of slots spaced radially about said projection and a contact end extends away from said negative terminal rear portion through each of said slots of said sleeve in said cavity of said housing.

5. An assembly as set forth in claim 4 wherein one of said contact ends is a negative terminal housing connection for being electrically connected with the vehicle accessory, said negative terminal housing connection is a spade type terminal having a generally rectangular shape.

6. An assembly as set forth in claim 1 and further including a positive wire disposed in said housing in electrical connection with the vehicle accessory, said proximal portion of said positive terminal defines a bore extending therein for receiving and being crimped around said positive wire.

7. An assembly as set forth in claim 1 further comprising a socket including a body having a cup shape defining a chamber therein and extending along a socket axis from an open portion to a closed portion for receiving said tip assembly of said plug, said socket further including a power connector for being electrically connected with the battery of the vehicle for transmitting power through the socket.

8. An assembly as set forth in claim 7 and further comprising a casing of organic polymer material generally having a cup shape sealingly disposed about said closed portion of said body of said socket and said power connector for preventing liquids from entering said chamber of said body through said orifices.

9. An assembly as set forth in claim 7 and further including a pair of spring contacts disposed in said chamber of said body extending axially away from said closed portion of said body in spaced parallel relationship with one another and electrically connected with said power connectors for receiving said positive terminal of said plug.

10. An assembly as set forth in claim 7 and further including a socket LED disposed in said chamber of said socket and electrically connected with said power connectors for illuminating said chamber of said socket.

11. An assembly as set forth in claim 7 further comprising a spring cylinder disposed in said chamber of said body electrically connected with said power connectors for receiving said positive terminal of said plug, said spring cylinder including a spring cylinder wall having a generally cylindrical shape, said spring cylinder wall defining a plurality of slots radially spaced about said wall for allowing said wall to expand radially outwardly to receive said positive terminal of said plug.

12. An assembly as set forth in claim 11 further comprising at least one USB port interconnected with said housing and electrically connected with said tip apparatus for receiving cords from the vehicle accessory for powering the vehicle accessory, a USB LED interconnected with said housing and electrically connected with said USB port for indicating when a cord is plugged into said USB port.

13. A powering apparatus for attachment to a vehicle for being connected with a battery for providing power to a vehicle accessory comprising;

a socket including a body having a cup shape and extending along a socket axis from an open portion to a closed portion, said body having an inner wall defining a chamber and an outer wall, said body being made of a metal material for conducting electricity, said outer wall of said body defining a plurality of threads adjacent to said open end for sealingly securing said body to the vehicle, said socket further including a socket lid pivotally engaging said body at said open portion of said body for opening and sealingly closing said chamber of said body, said socket further including a pair of spring contacts disposed in said chamber of said body extending axially away from said closed portion of said body in spaced and parallel relationship with one another, each of said spring contacts defining an arc extending radially inwardly, said closed end of said body of said socket defining a pair of orifices, said socket further including a plurality of power connectors extending axially from said spring contacts and said inner wall of said body and through said orifices of said closed portion of said body and said power connectors being electrically connected with said inner wall of said body and said spring contacts for being electrically connected with the battery of the vehicle for transmitting power to said spring contacts, a plug for being interconnected with said socket for being electrically connected with said socket for powering the vehicle accessory, said plug including a housing defining a cavity and an opening into said cavity, said housing defining a flange extending radially inwardly into said opening, said housing being made of a molded organic polymer material, said shell further defining a connection aperture for sealingly receiving a cord of the vehicle accessory for being electrically connected with said positive terminal to power the vehicle accessory, said plug including a tip assembly received by said opening of said housing for extending into said socket, said tip assembly including a positive terminal having a generally cylindrical shape extending along a terminal axis between a proximal portion in said cavity of said housing and a distal portion outside of said housing for electrical connection with said vehicle accessory, said positive terminal having a apex having a conical shape at said distal portion for guiding said positive terminal between said spring contacts when said plug is inserted into said socket, said positive terminal defining a groove having a curve shape extending radially into said main positive terminal adjacent to said tip for receiving the arc of the spring contacts when said plug is inserted into said socket for elastically holding said plug in said socket to electrically connect said positive terminal of said plug and spring contacts of said socket, said positive terminal defining a recess spaced axially toward said proximal portion from said groove and having a generally rectangular cross section extending radially inwardly along a front barrier and a rear barrier extending in spaced and parallel relationship with said front barrier, a positive wire disposed in said housing in electrical communication with the vehicle accessory, said proximal portion of said positive terminal defining a bore extending therein for receiving said positive wire for electrically connecting said positive terminal and the vehicle accessory, a plurality of negative terminals each extending axially adjacent to said positive terminal for flexibly engaging said inner wall of said body of said socket for electrically connecting said negative terminals and said socket to ground said plug, said tip assembly further including a sheath of organic polymeric material sealingly disposed annularly about said positive terminal and extending between a back portion and a front portion for preventing liquids from flowing between said sheath and said positive terminal, said front portion of said sheath including an outside sheath leg positioned radially outwardly from positive terminal, said outside sheath leg defining an outside sheath leg protuberance extending radially outwardly therefrom for engaging said inner wall of said body inside said cavity, a plurality of negative terminals each extending axially adjacent to said positive terminal for flexibly engaging said inner wall of said body of said socket electrically connecting said negative terminals and said socket to ground said plug, said socket further including a casing of organic polymer material generally having a cup shape sealingly disposed about said closed portion of said body for preventing liquids from entering said chamber of said body through said orifices, said power connectors sealingly extending through said casing, said front portion of said sheath further including a plurality of inside sheath legs disposed radially inwardly from said outside sheath legs, said inside sheath legs each including an inside sheath leg lip extending radially inwardly into said recess in engagement with said front barrier of said positive terminal for restricting radially outward movement of said positive terminal relative to said sheath, said positive terminal further defining a trough generally having a square shape extending radially about said positive terminal at an axial location adjacent to said proximal portion of said positive terminal, said tip assembly further including a sleeve of organic polymeric material sealingly disposed about said proximal portion of said positive terminal in said cavity of said housing for preventing liquids from flowing from outside of said housing between said positive terminal and said sleeve into said cavity of said housing, said sleeve assembly generally having a cup shape and further being disposed about said back portion of said sheath, said sleeve including an extension having a generally square shaped cross section extending radially inwardly into said trough of said positive terminal for sealingly interconnecting said positive terminal and said sleeve, said sleeve having a projection having a generally L-shape extending radially outwardly therefrom adjacent to said proximal portion of said positive terminal and being in sealing engagement with said flange of said housing to sealingly interconnect said tip assembly and said housing, said projection of said sleeve of organic polymeric material defining a plurality of slots extending axially therethrough and spaced radially about said projection, said negative terminals being connected with one another at a negative terminal rear portion inside said housing engaging said projection of said sleeve and extending to a negative terminal front portion outside of said housing, said negative terminals further defining a contact end extending away from said negative terminal rear portion through each of said slots of said projection, one of said contact ends being a negative terminal housing connection extending away from said negative terminal rear portion inside said housing for being electrically connected with the vehicle accessory, said negative terminal housing connection being a spade type terminal having a generally rectangular shape, said organic polymeric material being one of an acrylonitrile butadiene styrene and sadiprene and rubber.

14. An apparatus as set forth in claim 13 wherein said housing comprising an upper case and a lower case being connected at a joint, said upper case including an upper tube being threaded extending therefrom into said cavity, said lower case including a lower tube being threaded extending therefrom into said cavity, a securing screw threadedly extending through said upper and lower tubes to secure said upper and lower case.

15. An apparatus as set forth in claim 14 wherein said housing has a generally frustoconical shape, said housing extends along said terminal axis between a housing proximal segment defining said connection aperture and a housing distal segment defining said opening.

16. An apparatus as set forth in claim 14 wherein said housing generally has an L-shape, said housing includes a horizontal portion extending along said terminal axis from a horizontal portion proximal segment to a horizontal portion distal segment defining said opening, said housing further includes a vertical portion extending perpendicularly away from said horizontal portion adjacent said horizontal portion proximal portion to a vertical portion distal segment defining said connection aperture.

17. An apparatus as set forth in claim 13 and further including at least one USB port disposed in said connection aperture being electrically connected with said tip apparatus for receiving cords from the vehicle accessory for powering the vehicle accessory, an LED interconnected with said housing and electrically connected with said USB port for indicating when a cord is plugged into said USB port, a USB sleeve pivotally interconnected with said housing adjacent to said USB port for opening and sealingly closing said USB port.

* * * * *